US006563412B2

(12) United States Patent
Paris

(10) Patent No.: US 6,563,412 B2
(45) Date of Patent: May 13, 2003

(54) ROTARY VARIABLE DIFFERENTIAL TRANSFORMER

(75) Inventor: Brian D. Paris, Warminster, PA (US)

(73) Assignee: Harold Beck and Sons, Inc., Newtown, PA (US)

( * ) Notice: Subject to any disclaimer, the term of this patent is extended or adjusted under 35 U.S.C. 154(b) by 2 days.

(21) Appl. No.: 09/850,972

(22) Filed: May 8, 2001

(65) Prior Publication Data

US 2002/0167384 A1 Nov. 14, 2002

(51) Int. Cl.[7] ..... H01F 21/04

(52) U.S. Cl. ..... 336/115; 336/77; 336/79; 310/258; 310/259; 310/260; 310/261

(58) Field of Search ..... 336/77, 79, 115, 336/132, 232; 310/258–261, 265, 266, 270, 40 MM, 168

(56) References Cited

U.S. PATENT DOCUMENTS

| | | | | |
|---|---|---|---|---|
| 3,551,866 A | * | 12/1970 | Chass | 336/132 |
| 3,641,429 A | | 2/1972 | Cox, Jr. et al. | |
| 4,004,251 A | | 1/1977 | Hesler et al. | |
| 4,672,347 A | | 6/1987 | Garcia et al. | |
| 4,809,742 A | | 3/1989 | Grau | |
| 5,274,291 A | * | 12/1993 | Clarke | 310/112 |
| 5,402,096 A | | 3/1995 | Harris | |
| 5,701,114 A | | 12/1997 | Chass | |
| 2002/0036495 A1 | * | 3/2002 | Hannewald et al. | 324/207.2 |

* cited by examiner

*Primary Examiner*—Elvin Enad
*Assistant Examiner*—Jennifer A Poker
(74) *Attorney, Agent, or Firm*—Akin, Gump, Strauss, Hauer & Feld, L.L.P.

(57) ABSTRACT

A rotary variable differential transformer apparatus for determining angular position of a rotor includes a stator support structure, a first pair of magnetically permeable stator elements and a second pair of magnetically permeable stator elements. The first and second pairs of stator elements are connected via first and second connecting members, respectively and are substantially supported by the stator support structure. Circuitry for generating a position indicator signal, including an array of coils is coupled to the first and second pairs of stator elements. A rotor is mounted within the stator support structure and substantially surrounded by the first and second pairs of stator elements. The rotor has a magnetic flux conducting element mounted thereon, which couples each of the first and second pairs of magnetically permeable stator elements in a manner which varies in proportion to the angular position of the rotor.

12 Claims, 5 Drawing Sheets

ROTARY VARIABLE DIFFERENTIAL TRANSFORMER

BACKGROUND OF THE INVENTION

The invention relates to a rotary variable differential transformer and, in particular, a rotary variable differential transformer which may be used as a non-contacting sensor to determine angular position of an output shaft of, for example, a valve actuator.

Maintaining the accurate positioning of an actuator output shaft requires the use of a feedback device to sense the output shaft position and provide a signal to the actuator control electronics. The accuracy of the feedback signal is affected by the linking method between the sensor and the output shaft, and the accuracy of the sensor.

The basic elements of an actuator system having a feedback device include an actuator output shaft, a position sensing device, a physical link between the output shaft and the position sensing device and actuator control electronics. The physical link between the output shaft and the position sensing device typically depends on the type and location of the position sensing device. If the sensing device is located in close proximity to the output shaft (one inch or less), the link can be optical, capacitive, magnetic, or electrical. If the sensing device is not located in close proximity, the link can be optical, or mechanical, using an extension of the shaft to create the effect of close proximity. Typically, a mechanical extension is used as the physical link between the actuator output shaft and the position sensor for reasons related to ease of manufacture, maintenance and reliability.

Applications using optical sensor devices are technology limited with regard to accuracy, tend to be expensive, are sensitive to environmental conditions and can be corrupted by opaque contamination. Applications using electrical sensor devices, typically potentiometers, can be relatively inexpensive and provide good accuracy but tend to provide poor reliability. Electrical sensor devices are also are subject to wear, corrosion, vibration, and other problems. Capacitive sensor devices can have good accuracy, but are sensitive to vibration, environmental conditions and contaminants.

Prior art devices for sensing the angular position include apparatus having two pairs of inductive coils mounted with a rotor. A magnetically permeable member comprises the rotor which is located between the pairs of coils and is rotatable about an axis perpendicular to the planes of the end faces of the coils. When the rotor rotates, the inductance of one coil of each pair increases while the inductance of the other coil of each pair decreases to provide an indication of rotational position of the rotor. Other prior art devices disclose a rotary differential transformer comprising a stator assembly having two circumferentially surrounding secondary coils and a single primary coil wound over both of the secondary coils. A rotor comprising a ferromagnetic core which is a hollow cylindrical section is positioned for rotation within the coil form. The coil form includes magnetic elements in specific locations that combine with the ferromagnetic core to form three distinct flux loops depending upon the rotational position of the rotor relative to the stator assembly. These prior art devices, however, can be difficult to manufacture and tend to suffer from poor reliability and poor accuracy due to their structural designs which are susceptible to excessive wear, corrosion, vibration and other problems.

Accordingly, a need remains for a reliable and accurate position sensing apparatus having improved manufacturability (e.g. machinability and cost effectiveness) and improved operating performance in terms of strength, durability, reduced distributed capacitance (i.e. improved bandwidth) and improved position signal output.

The present invention provides a rotary variable differential transformer (RVDT) apparatus. The apparatus may be used as a non-contacting sensor for determining the angular position of a shaft connected to the rotor of the RVDT apparatus. The apparatus is designed to reliably provide an accurate shaft position signal which can be transmitted to actuator control electronics. The apparatus is also designed to have a long service life and a high tolerance of a wide range of environmental conditions. The apparatus is easily manufactured and designed to be readily accessible for maintenance.

BRIEF SUMMARY OF THE INVENTION

Briefly stated, the present invention comprises a rotary variable differential transformer apparatus which includes a stator support structure and a first and second pair of magnetically permeable stator elements. The first and second pair of stator elements are supported by the stator support structure. First and second connecting members are used to connect the first pair of stator elements, and the second pair of stator elements respectively. Circuitry for generating a position indicator signal, including an array of planar coils is formed on a multi-layer printed circuit board. The circuit board containing the circuitry is coupled to the stator elements and fastened to the stator support structure using fasteners. A rotor is rotatably mounted within the stator support structure and substantially surrounded by the first and second pairs of magnetically permeable stator elements. A magnetic flux conducting element is fastened to the rotor. The rotor, when mounted within the stator support structure, magnetically couples each of the first pair of stator elements and the second pair of stator elements via the conducting element in a manner which varies in proportion to the angular position of the rotor.

BRIEF DESCRIPTION OF THE SEVERAL VIEWS OF THE DRAWINGS

The foregoing summary, as well as the following detailed description of preferred embodiments of the present invention, will be better understood when read in conjunction with the appended drawings. For the purpose of illustrating the present invention, there are shown in the drawings embodiments which are presently preferred. It should be understood, however, that the present invention is not limited to the precise arrangements and instrumentalities shown. In the drawings.

DETAILED DESCRIPTION OF THE INVENTION

Figure 1:
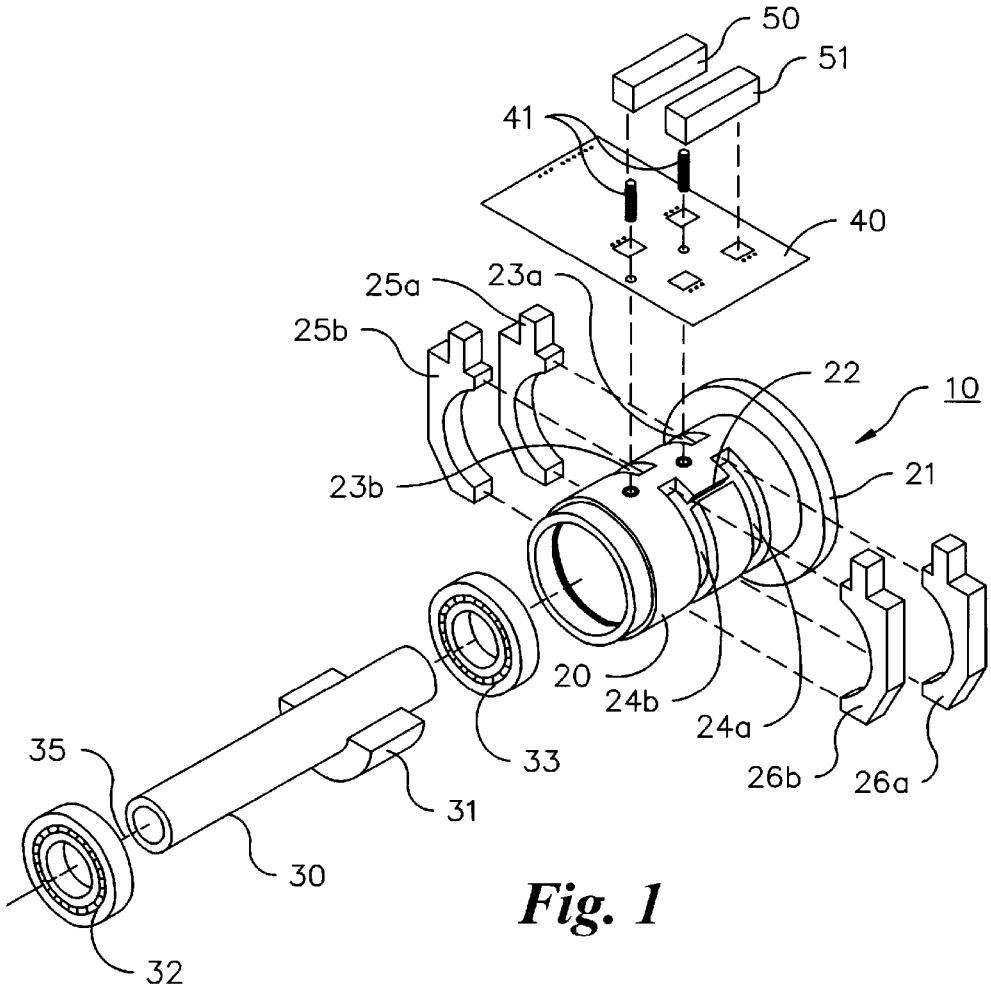
FIG. 1 is an exploded perspective view of a preferred embodiment of the RVDT apparatus in accordance with the present invention.

A first preferred embodiment of the present invention, shown in FIG. 1, is a rotary variable differential transformer (RVDT) apparatus 10 which in the present embodiment is used for determining angular position of a rotor 30. The apparatus preferably includes stator support structure 20, a first pair of magnetically permeable stator elements 25*a*, 25*b*, and a second pair of magnetically permeable stator elements 26*a*, 26*b*. The first and second pairs of stator elements, are preferably received within suitably sized and shaped openings in the stator support structure 23*a–b* and 24*a–b* respectively, and are substantially supported within the stator support structure 20. First and second connecting members 50 and 51 are preferably used to connect the first pair of stator elements 25*a*, 25*b*, and the second pair of stator elements 26*a*, 26*b* respectively. A circuit board 40 containing circuitry 45 (not shown in FIG. 1) is preferably coupled to the stator elements 25*a*, 25*b*, 26*a*, 26*b* and fastened to the stator support structure 20 using fasteners 41. A rotor 30 is rotatably mounted within the stator support structure 20. A magnetic flux conducting element 31 is secured to or formed as part of the rotor 30. The rotor 30 and magnetic flux conducting element 31, when mounted within the stator support structure 20, magnetically couple each of the first pair of magnetically permeable stator elements 25*a*, 25*b* and the second pair of magnetically permeable stator elements 26*a*, 26*b* via the conducting element 31 in a manner which varies in proportion to the angular position of the rotor.

The RVDT apparatus 10 can be used as a position sensing device when coupled to, for example, the output shaft of an actuator (not shown). The rotor 30 of the RVDT apparatus 10 can be coupled to the output shaft of the actuator by any commonly known or used means such as a threaded shaft coupling or any other type of mechanical link. The position of the output shaft of the actuator can be accurately determined by the RVDT apparatus 10 so that a feedback signal can be generated and transmitted to the control electronics of the actuator. Preferably, the RVDT apparatus 10 can measure shaft rotations of at least about 150 degrees. More preferably, the RVDT apparatus 10 can measure shaft rotations of at least about 360 degrees.

The stator support structure 20 is preferably formed from stainless steel and is designed to act as a mechanical support for the other components of the RVDT apparatus 10. Preferably, the stator support structure 20 is generally cylindrical in shape with arcuate opening 23*a–b* and 24*a–b*, sized to receive the stator elements 25*a–b* and 26*a–b* respectively. Use of stainless steel as the material for the stator support structure provides for reduced transfer of magnetic flux between the magnetically permeable stator elements 25*a*, 25*b*, 26*a*, 26*b*. The stator support structure 20 can alternatively be made of any suitable material commonly known or used in the art.

The stator support structure 20 is also preferably adapted for servo mounting. Servo mounting allows for proper alignment of the RVDT apparatus 10 and minimizes errors in determining the angular position of the rotor 30. When the rotor 30 is coupled to an output shaft of an actuator, servo mounts provide superior concentric shaft alignment. As shown in FIG. 1, a servo mount may comprise a cylindrical flange 21.

Servo mounts also allow the RVDT apparatus 10 to be rotationally aligned wherein the stator support structure 20 is rotated to attain a specific relationship between the stator support structure 20 and an output shaft coupled to the rotor 30. In many applications, rotational alignment of the RVDT apparatus 10 is important since a position signal generated by the RVDT apparatus 10 is preferably a function of the relative rotational position of the stator support structure 20 to the rotor 30. Providing rotational alignment of the stator support structure 20 allows for attaining a consistent relationship between the rotor 30 position and an output signal.

Modifications to standard servo mount techniques can be made to accommodate specific applications. For example, a notch (not shown) may be formed in the servo mount 21 which matches a protrusion in the mounting surface to restrict the range of rotation of the stator support structure 20. The notch prevents the stator support structure 20 from improper rotational alignment during installation. The rotational alignment range is preferably restricted such that alignment of the RVDT apparatus 10 does not result in unacceptable inaccuracy.

Magnetically permeable stator elements 25*a*, 25*b*, 26*a*, 26*b*, are preferably made of ferrite or other flux conducting material and are mounted within the stator support structure 20. The stator elements act as conduits for the conduction of magnetic fields created by the circuitry 45 (shown in FIG. 4 and discussed below). The stator elements of 25*a*, 25*b*, 26*a*, 25*b* each preferably having at least one substantially arcuate surface.

The stator support structure 20 preferably acts as a Faraday shield to substantially shield the magnetically permeable stator elements 25*a*, 25*b*, 26*a*, 26*b* from externally applied electric and magnetic flux. Slots connecting opening 23*a* to 23*b* and 24*a* to 24*b* (one of which is shown as 22 in FIG. 1), are preferably cut in the stator support structure 20 to prevent the stator support structure 20 from acting as a shorted turn.

The temperature coefficients for the stator support structure 20 and the magnetically permeable stator elements 25*a–b*, 26*a–b* are preferably substantially the same. Matching the temperature coefficients of the stator support structure 20 and the magnetically permeable stator elements 25*a–b*, 26*a–b* allows use of a "hard" bonding agent to bond the stator elements 25*a–b*, 26*a–b* to the stator support structure 20. The stator elements 25*a–b*, 26*a–b* are preferably bonded to the stator support structure 20 using a substantially non-flexible bonding agent which maintains proper alignment of the stator elements 25*a–b*, 26*a–b* in the stator support structure 20. The stress level in the non-flexible bonding agent remains low since there is similar relative growth in the stator support structure 20 and the magnetically permeable stator elements 25*a–b*, 26*a–b*, as a function of temperature. Additionally, reduced stress prevents stress-induced changes in the ability of the stator elements 25*a–b*, 26*a–b* to carry magnetic flux.

Magnetically permeable stator element 25*a* and stator element 25*b* are preferably connected by a first connecting member 50. Stator element 26*a* and stator element 26*b* are preferably connected by a second connecting member 51. The connecting members 50, 51 are preferably elongated bar-shaped members having a substantially square cross section. The connecting members 50, 51 are also preferably made of ferrite or other flux conducting material. In a preferred embodiment shown in FIG. 1, each of the stator elements 25*a*, 25*b*, 26*a*, 26*b*, has a portion which extends away from the stator support structure for engaging the connecting members 50, 51 and the circuitry 45 on a circuit board 40 (discussed below). The connecting members 50, 51 are preferably secured to the stator elements 25*a*, 25*b*, 26*a* and 26*b* using threaded fasteners 41 and a retaining member (not shown) which acts to secure the connecting members 50, 51 to the stator elements 25*a*, 25*b*, 26*a* and 26*b*.

The rotor 30 is preferably supported for rotation within the stator support structure 20 using roller bearing members 32, 33 one at each axial end of the stator support structure. The roller bearing members 32, 33 preferably act together to provide axial and radial alignment between the rotor 30 and the stator support structure 20. Ball bearings (not shown) are preferably used in the roller bearing members 32, 33 to reduce drag between the rotor 30 and the stator support structure 20. One or more retaining rings (not shown) can be used to maintain the axial alignment of the rotor 30 within the stator support structure 20.

Figure 3:
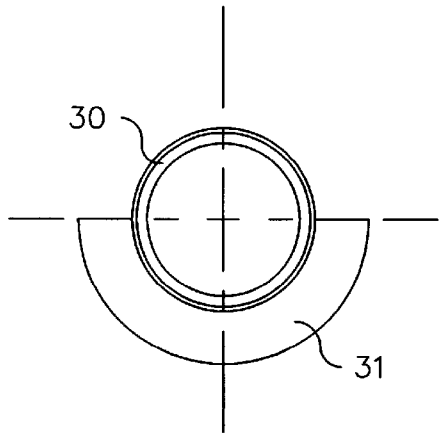
FIG. 3 is an end view of the rotor of the embodiment of FIG. 1.

As seen in FIGS. 1 and 3, the rotor 30 includes a magnetic flux conducting element 31. The conducting element 31 is preferably a half cylinder or C-shaped arcuate plate extending about 180° around a longitudinal axis 35 of the rotor 30. The rotor 30 is preferably hollow to provide a method for allowing an extension of an output shaft connected to the rotor 30 to pass through the rotor 30.

Figure 5:
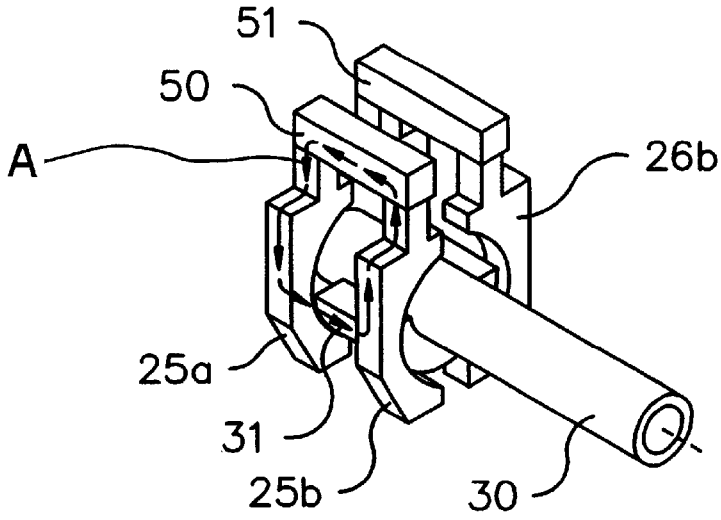
FIG. 5 is a perspective view, partially broken away, of the stator elements, the connecting members and the rotor showing magnetic path A of the RVDT apparatus of the embodiment of FIG. 1.
Figure 6:
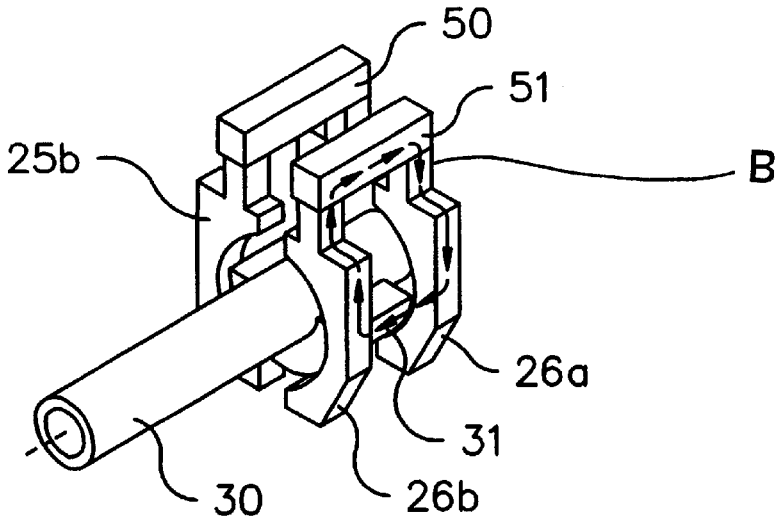
FIG. 6 is a perspective view, partially broken away, of the stator elements, the connecting members and the rotor showing magnetic path B of the RVDT apparatus of the embodiment of FIG. 1.

When the rotor 30 is supported within the stator support structure 20, the conducting element 31 magnetically couples the magnetically permeable stator elements, 25*a* and 25*b*, and magnetically couples magnetically permeable stator elements 26*a* and 26*b*, in a manner which varies in proportion to the angular position of the rotor 30. As illustrated in FIG. 5, the connection of the magnetically permeable stator elements, 25*a* and 25*b* by the connecting member 50, and the coupling of the magnetically permeable stator elements 25*a* and 25*b* by the conducting element 31 creates a magnetic path, referred to herein as magnetic path A. As illustrated in FIG. 6, the connection of the magnetically permeable stator elements 26*a* and 26*b* by the connecting member 51, and the coupling of the magnetically permeable stator elements 26*a* and 26*b* by the conducting element 31 creates a magnetic path, referred to herein as magnetic path B.

The circuit board 40 is preferably a printed circuit board and contains circuitry 45 for creating magnetic fields, measuring the magnetic fields and converting the magnetic information into electrical information in the form of an output position signal. The circuitry 45 may also create a signal representing diagnostic information concerning the reliability of the RVDT apparatus 10. Circuit board 40 is preferably mounted to the stator support structure 20 using threaded fasteners 41. Alternatively, circuit board 40 may be mounted to stator support structure 20 using any means commonly known or used.

Figure 2:
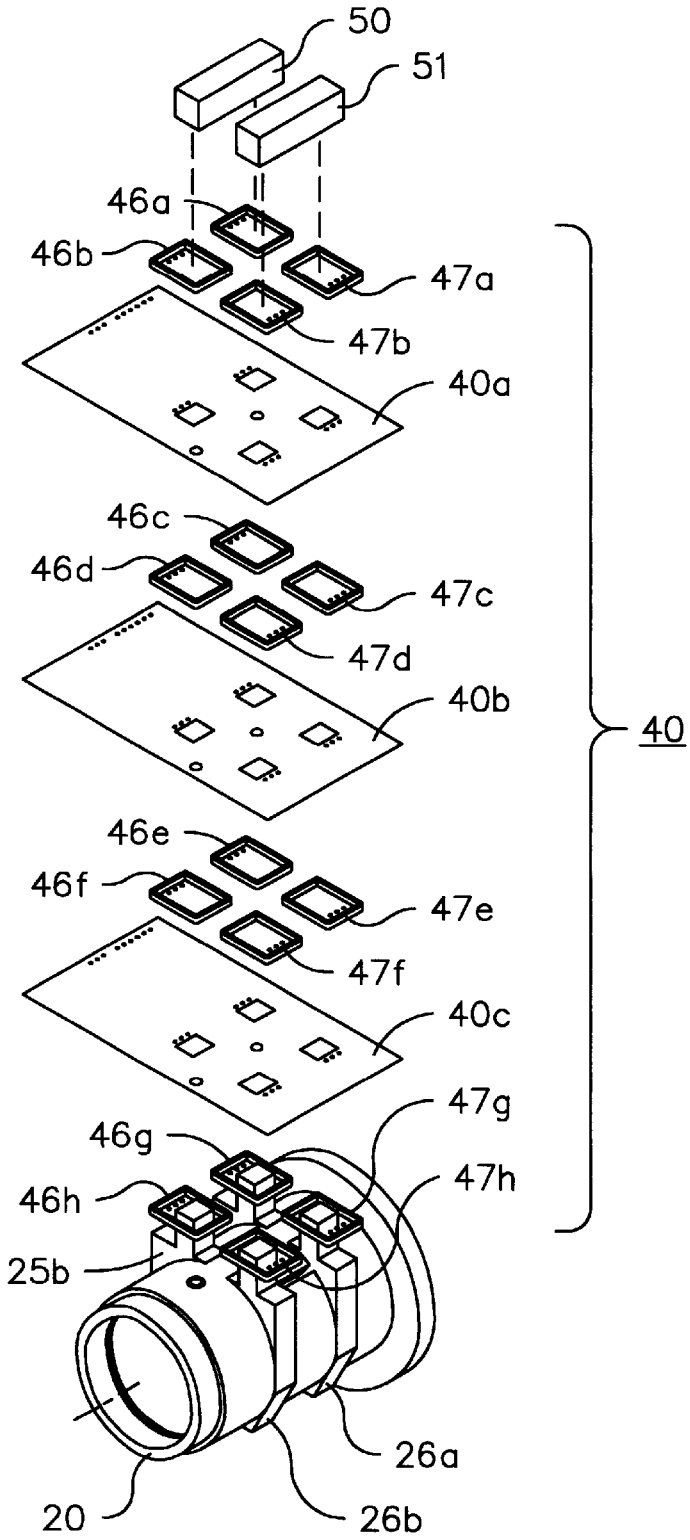
FIG. 2 is a partially exploded view of the stator support structure and circuit board of the embodiment of FIG. 1.

In one preferred embodiment shown in FIG. 2, the circuit board 40 includes three insulating layers 40*a*, 40*b*, and 40*c*, and an array of planar coils 46*a–h*, 47*a–h*. Coils 46*a*, 46*b*, 46*g*, 46*h*, 47*a*, 47*b*, 47*g*, 47*h* are excitation coils for creating magnetic fields which are applied to the magnetically permeable stator elements 25*a*, 25*b*, 26*a*, 26*b*.

Coils 46*c*; 46*d*, 46*e*, 46*f*, 47*c*, 47*d*, 47*e*, and 47*f* are sensing coils. The sensing coils when coupled to the stator elements 25*a*, 25*b*, 26*a*, 26*b* develop voltages in response to the magnetic flux through the stator elements 25*a*, 25*b*, 26*a*, 26*b*. The array of planar coils 46*a–h*, 47*a–h* are preferably etched onto the circuit board 40.

The distribution and winding of the array of planar coils 46*a–h*, 47*a–h* serve to minimize the distributed capacitance of the coils. Coils 46*a–h*, 47*a–h* are preferably formed with a symmetrical layout pattern which complements the symmetrical magnetic paths in the stator. The excitation coils 46*a*, 46*b*, 46*g*, 46*h*, 47*a*, 47*b*, 47*g* and 47*h* are preferably formed as parallel sets of coils so as to reduce the current necessary in each coil path to create the magnetic fields in the stator elements 25*a–b*, 26*a–b*. Each excitation coil is preferably wound on a circuit board layer as a concentric spiral in a bifilar manner (i.e. having two parallel paths in the spiral).

Preferably the excitation coils are driven with a substantially similar voltage wave form, discussed below, causing the voltage between conductors of the coils to be substantially minimized. By maintaining a low voltage between the excitation coils, coil-to-coil current is minimized, allowing for efficient production of magnetic fields in the stator elements 25*a–b*, 26*a–b*.

Excitation coils 46*a*, 46*b*, 46*g*, 46*h*, 47*a*, 47*b*, 47*g* and 47*h* are preferably positioned on a bottom layer and a top layer of the circuit board 40. Since magnetic paths A and B each pass through the circuit board 40 twice, each magnetic path passes through four sets of excitation coils. Preferably the magnetic forcing function from each coil is additive, and the forcing function from each coil is substantially the same. Having the forcing function from each coil additive and substantially the same creates four points of substantially equal magnetic induction. Four substantially equal and distributed induction points assist in optimizing the consistency of the magnetic flux inside magnetic paths A and B.

Preferably sensing coils 46*c*, 46*d*, 46*e*, 46*f*, 47*c*, 47*d*, 47*e* and 47*f* are preferably positioned on two inside layers of the circuit board 40. The sensing coils are preferably placed on the magnetic paths between the excitation coils, and more preferably at a position of highest magnetic flux concentration.

Separating the excitation coils from the sensing coils by insulating layers 40*a*, 40*b* and 40*c* preferably acts to control the capacitance between the excitation coils and the sensing coils.

Figure 4:
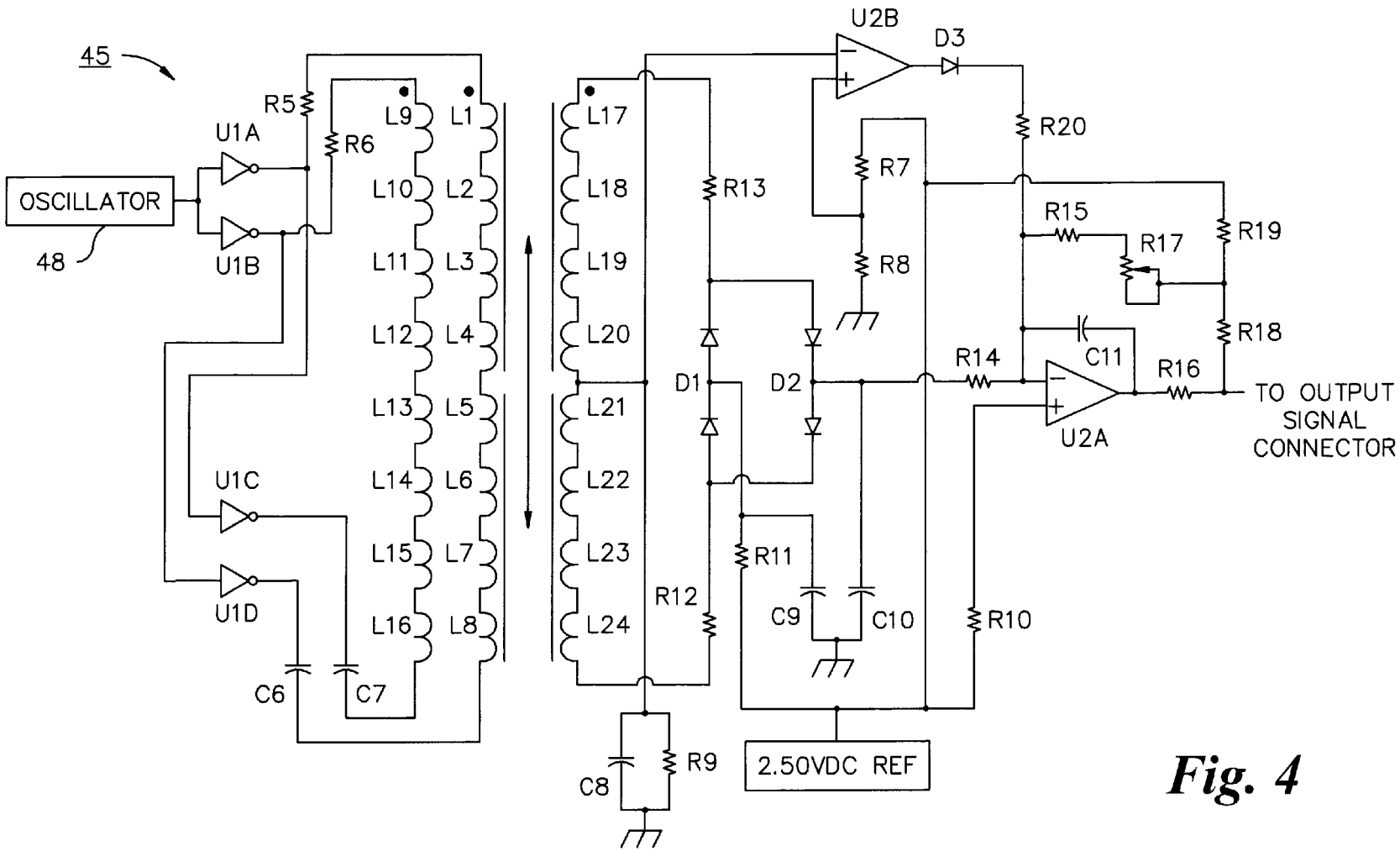
FIG. 4 is a schematic diagram of the circuitry of the embodiment of FIG. 1.

A schematic diagram of one preferred embodiment of circuitry 45 is shown in FIG. 4. Circuitry 45 preferably operates at a frequency of about 0.4 MHz and includes, as discussed in detail below, an oscillator; a power stage coupled to the oscillator; a plurality of excitation coils coupled to the power stage; sensing coils which may be inductively coupled to the excitation coils by the stator elements; a discriminator circuit coupled to the sensing coils; and an output circuit coupled to the discriminator circuit. The operating frequency is preferably selected to maintain a low power consumption and low internal circulating currents. Additionally, using a relatively high operating frequency allows the stator support structure 20 to act as an effective Faraday field (as discussed above).

The oscillator 48 of FIG. 4 preferably comprises a circuit (not shown) of a known type for generating a time repetitive wave form which approximates a square wave. The repetitive output waveform is preferably used to control the power stage. The power stage is represented in FIG. 4 as buffers U1A–D. The power stage is preferably an integrated circuit which controls the voltages of the excitation coils. The excitation coils are shown in FIG. 4 as L1–16. The integrated circuit is preferably designed to provide accurate wave forms and efficient transfer of current. The power stage preferably acts as a power booster intermediary between the oscillator and the excitation coils and comprises four buffer subsystems U1 A–D. The four subsystems are preferably symmetrically connected to the excitation coils, and share the task of inducing magnetic flux, thereby creating a more efficient and reliable circuit.

The power stage preferably creates periods of opposite voltage polarity on the excitation coils. By reversing the voltage polarity on the excitation coils, the current in the excitation coils reverses and the magnetic flux created by the excitation coils is a reversing field of substantially equal and opposite magnitude and with substantially equal periods of time for each magnitude. Reversing the current and magnetic flux provides for reduced overall power consumption and a higher quality magnetic waveform.

Excitation coils shown in FIG. 4 correspond to FIG. 2 in the following relationship: L1 and L9 to 46*h*, L2 and L10 to 46*b*, L3 and L11 to 46*a*, L4 and L12 to 46*g*, L5 and L13 to 47*g*, L6 and L14 to 47*a*, L7 and L15 to 47*b*, L8 and L16 to 47*h*. As can be understood from FIGS. 2 and 4, and the above description each of the excitation coils 46*a–b*, 46*g–h*, 47*a–b*, and 47*g–h* of FIG. 2 represent a double wound coil.

Excitation coils L1–4 and L9–12 are preferably connected in series with excitation coils L5–8*a* and L13–16. Excitation coils L1–4 and L9–12 are preferably coupled to the magnetically permeable stator elements 25*a* and 25*b* and create magnetic flux in magnetic path A. Excitation coils L5–8 and L13–16 are preferably coupled to the magnetically permeable stator elements 26*a* and 26*b* and create magnetic flux in magnetic path B. The series connection of the excitation coils ensures that the effort to create magnetic flux in magnetic paths A and B is substantially equal.

Capacitors C6 and C7 are preferably included in the circuitry 45 for blocking average current (or DC current) in the coils, ensuring that the average current in the coils is kept to about zero. The average current in the coils creates magnetic flux which cannot be sensed with the sensing coils and can consume high amounts of energy.

Resistors R5 and R6 are preferably included in circuitry 45 for reducing electromagnetic interference. Oscillating voltages such as those applied to the excitation coils tend to create substantial electromagnetic noise. Such noise can reduce circuit efficiency and can cause interference with other electronic systems. Resistors R5 and R6 are thus used to limit the amount of energy that can create electromagnetic noise.

Sensing coils L17–24 develop voltages in response to the strength of the magnetic fields passing through the magnetically permeable stator elements 25*a–b* and 26*a–b*. Sensing coils of FIG. 4 correspond to sensing coils of FIG. 2 in the following relationship: L17 to 46*f*, L18 to 46*d*, L19 to 46*c*, L20 to 46*e*, L21 to 47*e*, L22 to 47*c*, L23 to 47*d*, and L24 to 47*f*

Sensing coils L17–20 (46*c–f*) are preferably coupled to the magnetically permeable stator elements 25*a* and 25*b* and sense the magnitude of the magnetic flux in magnetic path A. Sensing coils L21–24(47*c–f*) are preferably coupled to the magnetically permeable stator elements 26*a* and 26*b* and sense the magnitude of the magnetic flux in magnetic path B.

The voltage waveforms of the sensing coils are preferably a function of the voltage waveform on the excitation coils, the number of coil turns on the excitation coils, the number of coil turns on the sensing coils, and the reluctance of the magnetic paths A and B.

For example, if the excitation supply voltage is 5 vdc, the number of excitation coil turns is 52 and the number of sensing coil turns is 104, the sensing coil voltage measured across both sensing coils would preferably be about 10 v. The proportion of the 10 v that appears on the sensing coils for path A versus path B depends on the angular position of the rotor 30.

Resistors R12 and R13 are preferably included in the circuitry 45 as sensing coil burden resistors and act to limit the total current in the sensing coils and to allow the difference between the voltages across the sensing coils for the two paths to be measured.

Diode sets D1 and D2 are preferably included in the circuitry 45 as a diode "discriminator" set. The diodes are preferably used to rectify or convert the reversing currents in the sensing coils to non-reversing currents so that an angular position output signal generated therefrom is a steady voltage signal which can be sent to, for example, actuator control electronics. Diode sets D1 and D2 are also used to subtract the sensing coil current of path A from the sensing coil current of path B. The difference of the current in path A and path B is sent through resistor R14 and to a control output amplifier U2A.

A voltage reference circuit is preferably used to create a fixed reference voltage of 2.50 vdc which is also input to the output signal amplifier U2A. As a result the output signal of U2A is 2.50 vdc whenever the sensing coils of path A and path B have non-zero and equal reversing currents. If the currents on sensing coils for path A and for path B are both zero, the output signal is preferably controlled by other circuitry, which is discussed below.

The circuitry 45 preferably operates on a supply voltage of 5.00 vdc. The 2.50 vdc reference voltage is the center of the 5.00 vdc supply voltage. This provides for a 2.50 vdc range of output signal voltages to express the angular positions of the rotor 30 which improve (i.e. reduce the reluctance of) magnetic path A and provides for a 2.50 vdc range of output signal voltages to express the angular positions of the rotor 30 which improve magnetic path B.

Resistors R7 and R8 are preferably included in circuitry 45 as a voltage divider which creates a reference voltage of approximately 0.30 vdc less than the 2.50 vdc reference. The lower reference voltage is used as an input to a signal comparator U2B.

Resistor R9 and capacitor C8 are preferably included in the circuitry 45 as sensing coil common voltage reference components. Resistor R9 and capacitor C8 create a reference voltage for the common connection of the sensing coils for magnetic paths A and B. Capacitor C8 develops an average voltage based on the average current flowing into and out of capacitor C8. In normal operation of circuitry 45, the voltage across each sensing coil exceeds the voltage needed to cause conduction in diode sets D1 and D2 and the average voltage across capacitor C8 is approximately 2.50 vdc. Resistor R9 is preferably sized significantly larger than resistors R12 and R13, and acts to reduce the voltage across capacitor C8.

In situations of improper operation, the voltage across each sensing coil may not exceed the voltage needed to cause conduction in diode sets D1 and D2. Improper operation can include any condition which prevents generation, flow and sensing of magnetic fields in the magnetically permeable stator elements 25*a–b* and 26*a–b* (e.g., problems with the oscillator, excitation coils, magnetic path, sensing coils, etc.). Under conditions of improper operation, the voltage across capacitor C8 becomes approximately 1.80 vdc. Since resistor R9 reduces the voltage across capacitor C8, the voltage across capacitor C8 changes from about 2.50 vdc to about 1.80 vdc when the sensing coil voltages change from normal to improper operation conditions.

Amplifier U2B is preferably included in circuitry 45 as a reference comparator. The amplifier U2B is preferably used to compare the voltage level of the reference voltage of resistors R7 and R8 to the reference voltage of capacitor C8 and resistor R9. In normal operation, the reference voltage of capacitor C8 and resistor R9 is higher than the reference voltage of resistors R7 and R8 (i.e. about 0.3 vdc), and therefore the output of amplifier U2B is approximately 0 vdc. The output of amplifier U2B is preferably available as an output signal and is also connected to diode D3. Applying approximately 0 vdc to diode D3, diode D3 effectively becomes and open circuit. Accordingly, the output of amplifier U2A represents the relative strength of the magnetic flux in stator paths A and B.

In conditions of improper operation, the reference voltage of capacitor C8 and resistor R9 is lower than the reference voltage of resistors R7 and R8, and therefore the output of amplifier U2B is approximately 5 vdc. The output of amplifier U2B is preferably available as an output signal and is also connected to diode D3. Applying approximately 5 vdc to diode D3, diode D3 effectively becomes a closed circuit and applies a voltage of approximately 4.3 vdc to diode D3 and resistor R20. The resulting current flowing through resistor R20 causes amplifier U2A to make the output signal become approximately 0 vdc. An output voltage signal of approximately 0 vdc is outside of the preferred signal range, and can be used as an indicator of failure of the RVDT apparatus 10.

Diode sets D1 and D2 and resistor-capacitor sets R11-C9 and R14-C10 are preferably used in circuitry 45 as a discriminator. Diode sets D1 and D2 steer current from the sensing coils into resistor-capacitor set R11-C9 or R14-C10. Capacitors C9 and C10 average the effect of the sensing coil currents, which aids in allowing the output signal amplifier U2A to create low-noise signals indicating the position of the rotor 30.

Current flow through diodes set D2 takes place when the voltage at resistor R13 is greater than the voltage at resistor R12. Current flow through diode set D1 takes place when the voltage at resistor R13 is less than the voltage at resistor R12. In normal operation, the voltage at the junction of resistors R14 and R15 is approximately 2.50 vdc. The current through resistor-capacitor set R14-C10 preferably controls the output signal from the output signal amplifier U2A. The output signal amplifier U2A is preferably configured as an inverting amplifier. Due to resistor R10 the positive input to output signal amplifier U2A is essentially connected to the 2.50 vdc reference voltage. Capacitor C11 reduces the noise in the amplifier output signal. Resistor R16 creates a relatively large resistance, protecting the output signal amplifier U2A from externally induced transients such as static electricity, and reduces the amplifier's sensitivity to degrading conditions of external circuit connections.

Resistors R15, R17, R18 and R19 are preferably included in circuitry 45 to establish the output signal range of the amplifier based on the voltage at the positive input to amplifier U2A and the current through resistor R14.

Resistor R19 is preferably a positive-temperature-coefficient thermistor. The resistance of resistor R9 preferably changes with temperature modifying the output signal of amplifier U2A and offsetting changes caused by ambient temperature. Ambient temperature can effect the performance of the magnetically permeable stator elements 25*a–b*, 26*a–b*, the connecting members 50, 51 and the conducting element 31, thereby affecting the magnetic patterns and the sensing coil voltages.

The RVDT apparatus 10 can also be modified to accommodate switches (not shown) as a convenience to users. The switches are preferably actuated by one or more cams mounted to rotor 30. The switches may be used for functions related to rotor position sensing. The functions can include an indication of the 'end of travel' of the rotor 30 or an indication of a specific intermediate rotor position. The switches are preferably mounted in a fixed position relative to the stator support structure 20. The cams mounted on the rotor 30 are preferably adjustable.

As can be understood from the above description, the RVDT apparatus 10 is designed to function as follows. The circuit board 40 including circuitry 45 and coils 46*a–h*, 47*a–h* induces a magnetic field in the magnetically permeable stator elements 25*a–b*, 26*a–b* by applying alternating electrical voltages to excitation coils 46*a–b*, 46*g–h*, 47*a–b*, 47*g–h*. The voltages applied to the excitation coils create currents, and the currents create magnetic fields. Sensing coils 46*c–f*, 47*c–f* develop voltages as a reaction to the magnetic fields in the magnetically permeable stator elements 25*a–b*, 26*a–b*. The excitation coils and sensing coils are associated with either magnetic path A or magnetic path B.

Voltages to create the magnetic fields in the stator elements are applied to the series combination of excitation coils of magnetic paths A and B. The total applied voltage is shared between the coils for magnetic path A and magnetic path B. The proportion of voltage that each coil takes is preferably not controlled. However, the series combination of excitation coils provides substantially the same electrical current flow in the coils associated with magnetic path A and magnetic path B. The electrical current establishes the forcing function that creates the magnetic flow in magnetic paths A and B. The magnetic flux which flows in magnetic paths A and B is limited by how receptive each path is to the magnetic flux.

Magnetic paths A and B are preferably identical with relation to each other. Both magnetic path A and magnetic path B share the magnetic flux conducting element 31. By changing the relative rotational position of the magnetic flux conducting element 31, the magnetic flux conducting element 31 improves the magnetic path A or the magnetic path B. When either magnetic path A or B is improved, the other path is worsened. The improved magnetic path accordingly carries more magnetic flux, and the associated sensing coil develops a higher voltage. This change allows measurement of the angular position of rotor 30.

Circuitry 45 is designed to subtract the electrical signals in the sensing coils for magnetic paths A and B. If the signals are balanced, the subtraction results in an intra-circuit signal of approximately 0 vdc. If the signals are not balanced, the intra-circuit signal may be positive or negative. The intra-circuit signal is preferably added to a fixed signal of approximately 2.50 vdc, and the resultant signal can be used as a rotor position signal which can be transmitted to, for example, the actuator motor control circuitry of an actuator attached to the RVDT apparatus 10. The magnetically permeable stator elements 25*a–b*, 26*a–b*, the connecting members 50, 51 and the conducting element 31 are preferably designed to minimize resistance to the flow of magnetic flux. An air gap preferably separates the magnetically permeable stator elements 25*a–b*, 26*a–b* from the conducting element 31. The air gap preferably has relatively high resistance to the flow of magnetic flux. This high resistance is used to increase or decrease the overall performance of magnetic paths A or B. The RVDT apparatus 10 is preferably designed such that the distance from the stator elements 25*a–b*, 26*a–b* to the conducting element 31, measured radially, is constant. Accordingly, the distance between stator elements 25*a–b*, 26*a–b* and conducting element 31 does not impact the balance between magnetic paths A and B.

Figure 7:
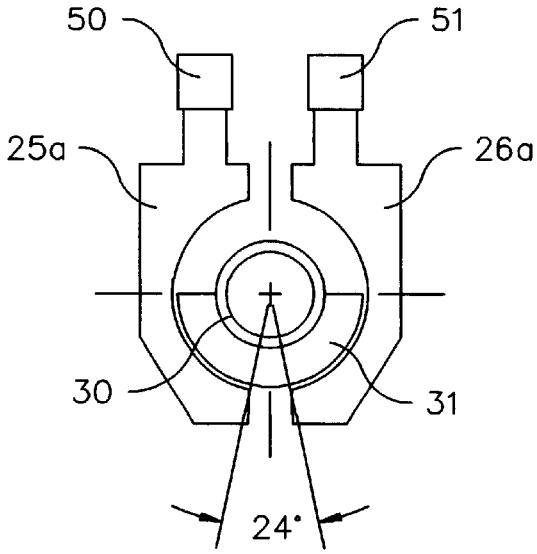
FIG. 7 is an end view of the stator elements, the connecting members and the rotor of the embodiment of FIG. 1 showing the rotor in a balanced position.

As shown in FIG. 7, stator elements 25*a–b*, 26*a–b* occupy approximately one hundred fifty-six degrees (156°) of the three hundred sixty degree (360°) arc of the inside diameter of the stator support structure 20. The stator elements 25*a–b* forming part of magnetic path A are preferably diametrically opposed to stator elements 26*a–b* which form part of magnetic path B.

As the rotational orientation of the rotor 30 and the conducting element 31 changes with respect to the stator support structure 20, a change takes place in the cross-sectional area of the air gap through which the magnetic flux travels. The arc of the conducting element 31 aligns with varying amounts of the arc of the stator elements 25*a–b*, 26*a–b* based on the rotational position of the rotor 30.

In a specific position, the rotor aligns equally with stator elements 25*a–b* and 26*a–b*. This position is typically referred to as the fifty percent (50%), or "balanced position."In the balanced position, the one hundred eighty degree (180°) arc of the conducting element 31 is distributed inside the stator support structure and stator elements as follows:

- about seventy-eight degrees (78°) aligned with the magnetically permeable stator elements 25*a–b* of magnetic path A
- about twenty-four degrees (24°) aligned with the gap between the magnetically permeable stator elements 25*a–b* and the magnetically permeable stator elements 26*a–b*
- about seventy-eight degrees (78°) aligned with the magnetically permeable stator elements 26*a–b* of magnetic path B The magnetic flux traveling in magnetic path A from the magnetically permeable stator elements 25*a–b* to the rotor must move through the radial length of the air gap between the magnetically permeable stator elements 25*a–b* and conducting element 31. The cross-section of the air gap is controlled by the length of the arc. Magnetic flux travelling through path B must travel through an air gap of the same radial length and the same cross-sectional area. Accordingly, the conducting element 31 enhances magnetic path A and magnetic path B equally, and the sensing coils coupled to magnetic path A and magnetic path B preferably measure substantially the same voltages. The result of subtracting the sensing coil voltages is approximately zero volt (0V).

Figure 8:
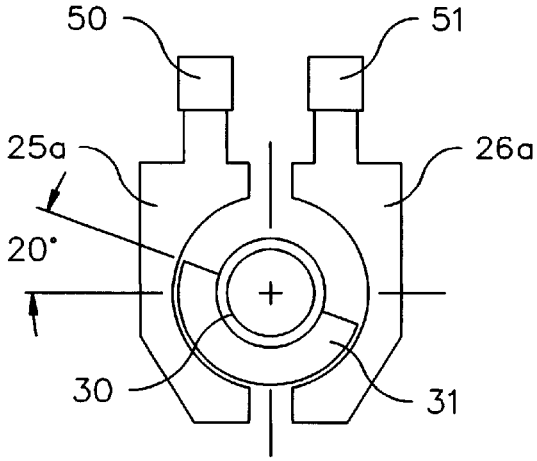
FIG. 8 is an end view of the stator elements, the connecting members and the rotor of the embodiment of FIG. 1 showing the rotor rotated toward magnetic path A.

As shown in FIG. 8, if the rotor 30 is oriented so that the conducting element 31 is aligned more with the stator elements 25*a–b* of magnetic path A, the one hundred eighty degree (180°) arc of the conducting element 31 is distributed inside the state of support structure 20 as follows:

- about ninety-eight degrees (98°) aligned with the magnetically permeable stator elements 25*a–b* of magnetic path A
- about twenty-four degrees (24°) aligned with the gap between the magnetically permeable stator elements 25*a–b* and 26*a–b*
- about fifty-eight degrees (58°) aligned with the magnetically permeable stator elements 25*a–b*, 26*a–b* of magnetic path B In the situation shown in FIG. 8, the radial air gap traveled by magnetic flux flowing through magnetic path A and magnetic path B is still approximately the same, however the cross-sectional area of the air gap for magnetic path A is approximately 1.69 times greater than for magnetic path B (98/58=1.69). Since the difficulty for magnetic flux in travelling through an air gap is inversely proportional to the area of the air gap, the magnetic flux travels more through magnetic path A than through magnetic path B. Therefore, sensing coils coupled to stator elements 25*a–b* of magnetic path A develop a voltage that is approximately 1.69 times greater than that for the magnetically permeable stator elements 26*a–b* of magnetic path B. Circuitry 45 which subtracts the sensing coil voltages from magnetic path A from magnetic path B preferably outputs a signal that indicates the angular position of the rotor 30 and the magnetic flux conducting element 31 is more aligned with magnetic path A.

Figure 9:
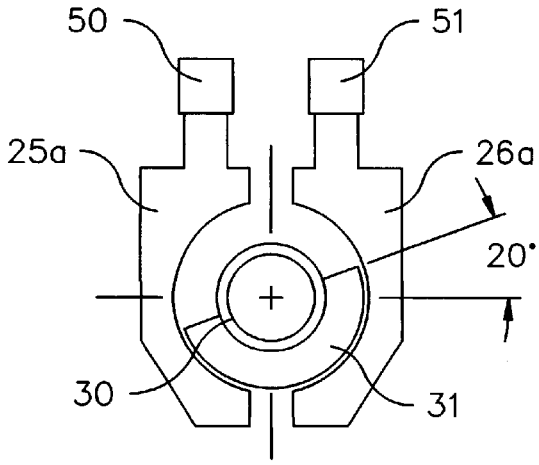
FIG. 9 is an end view of the stator elements, the connecting members and the rotor of the embodiment of FIG. 1 showing the rotor rotated toward magnetic path B.

As shown in FIG. 9, an opposite condition can exist as compared to the situation shown in FIG. 8. The rotor 30 and magnetic flux conducting element 31 being aligned more with the magnetically permeable stator elements 26*a–b* of magnetic path B result in the one hundred eighty degree (180°) arc of the magnetic flux conducting element 31 being distributed inside the stator support element 20 as follows:

- about fifty-eight degrees (58°) aligned with the magnetically permeable stator element 25*a–b* of magnetic path A
- about twenty-four degrees (24°) aligned with the gap between the magnetically permeable stator elements 25*a–b* and 26*a–b*
- about ninety-eight degrees (98°) aligned with the magnetically permeable stator elements 26*a–b* of magnetic path B In the orientation shown in FIG. 9, the radial air gap traveled by magnetic flux in magnetic path A and magnetic path B is still substantially the same, however, the cross-sectional area for the air gap for magnetic path B is approximately 1.69 greater than for magnetic path A (98/58=1.69). Since the difficulty for magnetic flux traveling through an air gap is inversely proportional to the area of the air gap, the magnetic flux travels more through magnetic path B than magnetic path A. Accordingly, sensing coils for magnetic path B develop a voltage that is approximately 1.69 times greater than for magnetic path A. Circuitry 45 preferably subtracts the sensing coil voltages and generates an output signal that indicates the angular position of rotor 30 as being more aligned with magnetic path B.

It will be appreciated by those skilled in the art that changes could be made to the embodiments described above without departing from the broad inventive concept thereof It is understood, therefore, that this present invention is not limited to the particular embodiments disclosed, but it is intended to cover modifications within the spirit and scope of the present invention as defined by the appended claims.

I claim:

1. A rotary variable differential transformer apparatus for determining angular position of a rotor, comprising:

a stator support structure;

a first pair of magnetically permeable stator elements substantially supported by the stator support structure, the magnetically permeable stator elements being connected to each other by a magnetically permeable first connecting member;

a second pair of magnetically permeable stator elements substantially supported by the stator support structure, the magnetically permeable stator elements being connected to each other by a magnetically permeable second connecting member;

circuitry for generating a position indicator signal, including an array of planar coils formed on a multi-layer printed circuit board coupled to the first pair of magnetically permeable stator elements and the second pair of magnetically permeable stator elements; and a rotor rotatably mounted within the stator support structure and substantially surrounded by the first and second pairs of magnetically permeable stator elements, the rotor having a magnetic flux conducting element which magnetically couples each element of the first pair of magnetically permeable stator elements and each element of the second pair of magnetically permeable stator elements in a manner which varies in proportion to an angular position of the rotor.

2. The apparatus of claim 1, wherein the circuitry for generating a position indicator signal includes an oscillator; a power stage coupled to the oscillator; a plurality of excitation coils coupled to the power stage; sensing coils inductively coupled to the excitation coils by the first and second pairs of magnetically permeable stator elements, the first and the second connecting members and the conducting element; a discriminator circuit coupled to the sensing coils; and an output circuit coupled to the discriminator circuit.

3. The apparatus of claim 1, wherein temperature coefficients of the stator support structure, the first pair of magnetically permeable stator elements and the second pair of magnetically permeable stator elements are substantially equal.

4. The apparatus of claim 1, wherein the first pair of stator elements and the second pair of stator elements are supported substantially within the stator support structure such that the stator support structure substantially shields the first pair of magnetically permeable stator elements and the second pair of magnetically permeable stator elements from electric and/or magnetic flux.

5. The apparatus of claim 1, wherein the stator support structure is slotted to prevent the stator support structure from acting as a shorted turn.

6. The apparatus of claim 2, wherein the circuitry for generating a position indicator signal further comprises circuitry for detecting failure of the oscillator, the power stage, the excitation coils, or the sensing coils.

7. The apparatus of claim 2, wherein the circuitry for generating a position indicator signal operates at a frequency of about 0.4 MHz.

8. The apparatus of claim 2, wherein the oscillator, the power stage and the plurality of excitation coils induce a magnetic field in the first and second pairs of magnetically permeable stator elements, the first and the second connecting members and the flux conducting element; the sensing coils sense the magnetic field in the first and second pairs of magnetically permeable stator elements; and the discriminator circuit and the output circuit generate a position indicator signal based on a difference in the magnetic field sensed in the first and second pairs of magnetically permeable stator elements.

9. A rotary transformer apparatus for determining an angular position of a rotor, comprising:

a stator support structure;

a plurality of magnetically permeable stator elements substantially supported by the stator support structure;

circuitry for generating a position indicator signal, including an array of coils formed on a printed circuit board magnetically coupled to the magnetically permeable stator elements; and a rotor rotatably mounted within the stator support structure and substantially surrounded by the plurality of magnetically permeable stator elements, the rotor having a magnetic flux conducting element which magnetically couples the magnetically permeable stator elements in a manner which varies in proportion to the angular position of the rotor to form at least a first magnetic path and a second magnetic path;

wherein the circuitry for generating a position indicator signal induces magnetic flux in the magnetically permeable stator elements of the first and second magnetic paths, senses the magnetic flux in the first and second magnetic paths, and generates a position indicator signal based on a difference in the magnetic flux sensed in the first and second magnetic paths.

10. The apparatus of claim 9, wherein the circuitry for generating a position indicator signal includes an oscillator; a power stage coupled to the oscillator; a plurality of excitation coils coupled to the power stage; sensing coils inductively coupled to the excitation coils by the magnetically permeable stator elements and the conducting element; a discriminator circuit coupled to the sensing coils; and an output circuit coupled to the discriminator circuit.

11. The apparatus of claim 9, wherein temperature coefficients of the stator support structure, the magnetically permeable stator elements and the conducting element are substantially equal.

12. The apparatus of claim 10, wherein the circuitry for generating a position indicator signal further comprises circuitry for detecting failure of the oscillator, the power stage, the excitation coils, the magnetic paths or the sensing coils.

* * * * *